US005924251A

United States Patent [19]

Jalla

[11] Patent Number: 5,924,251

[45] **Date of Patent: *Jul. 20, 1999**

[54] FOUNDATION IN EXPANSIVE SOIL

[76] Inventor: Maharaj K. Jalla, 7817 Calpurnia Ct., Mclean, Va. 22102

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,317

[22] Filed: Mar. 20, 1997

Related U.S. Application Data

[63] Continuation of application No. 08/638,803, Apr. 29, 1996, abandoned, which is a continuation of application No. 08/490,681, Jun. 15, 1995, abandoned.

[51] Int. Cl.[6] ..... F02D 27/00

[52] U.S. Cl. ..... 52/293.1; 52/293.3; 52/299

[58] Field of Search ..... 52/293.1, 293.3, 52/299, 169.5, 741.13, 741.15

[56] References Cited

U.S. PATENT DOCUMENTS

| | | | |
|---|---|---|---|
| 1,929,226 | 10/1933 | Watkins | 52/299 |
| 4,015,432 | 4/1977 | Ball | 52/169.5 X |
| 4,463,529 | 8/1984 | Singer et al. | 52/169.5 |
| 4,485,598 | 12/1984 | Guardiani | 52/299 X |
| 4,565,044 | 1/1986 | Takahara | 52/293.1 X |
| 4,886,399 | 12/1989 | Pidgeon | 52/741.15 X |
| 5,367,845 | 11/1994 | Hartling | 52/293.1 |

FOREIGN PATENT DOCUMENTS

| | | | |
|---|---|---|---|
| 404353124 | 12/1992 | Japan | 52/741.1 |
| 8004822 | 4/1982 | Netherlands | 52/293.1 |

*Primary Examiner*—Christopher Kent
*Assistant Examiner*—Timothy B. Kang

[57] ABSTRACT

The present invention relates to an improved poured concrete foundation for residential houses having foundation walls and built in expansive soil areas. The foundation consists of a perimeter trench footing which is monolithically constructed with a plurality of internal trench footings and column footings located within the perimeter footing; and the perimeter trench footing is integrated with a subsequently-constructed, overlying concrete foundation wall, throughout the perimeter of the foundation, using vertical reinforcing steel dowels of predetermined height at predetermined spacings. This ensures that the foundation wall behaves as a beam in addition to its primary functions of resisting lateral soil backfill load and transferring vertical building loads to the underlying perimeter footing. A plurality of grade beams monolithically constructed with a basement slab are placed at beam pockets provided at the footings. The resulting foundation structure, as a whole, is capable of resisting stresses of expansive soils without any detrimental settlement.

1 Claim, 7 Drawing Sheets

FOUNDATION IN EXPANSIVE SOIL

RELATED APPLICATION

This application is a continuation in part of application Ser. No. 08/638,803, filed on Apr. 29, 1996, now abandoned, which is a continuation in part of application Ser. No. 08/490,681, filed on Jun. 15, 1995, now abandoned.

INTRODUCTION

The present invention relates to an improved poured concrete foundation for residential houses having foundation walls and built in expansive soil areas.

Several techniques have been used in the past to solve problems caused by shrinking and swelling of expansive soils. One such technique is to utilize a massive slab and beam structure as a foundation which will not fail as the soil shrinks and expands. Another technique is to stabilize the expansive soil present under a foundation by injecting lime slurry material under high pressure. The effectiveness of the use of this lime material is variable and results are not predictable.

The prior art teaches the desirability of controlling the moisture content of expansive soil under a foundation. U.S. Pat. No. 4,534,143, issued to Goines et al., discloses a subsurface irrigation system causing water to slowly percolate into the expansive soil supporting a foundation so as to maintain the moisture content of the soil. U.S. Pat. No. 4,015,432, issued to Ball, discloses a foundation structure supported on a expansive soil moistened to its plastic limit. Through a moisture controlling barrier placed around the foundation periphery, moisture can be added to ensure that the moisture content of the soil remains at the plastic limit.

All the above-mentioned techniques suffer from one or more of the disadvantages of either being too expensive or too complicated to install. Moreover, the prior practice of construction of concrete foundations in expansive soil areas does not take into account the inherent property associated with a poured concrete wall of being capable of behaving as a beam to resist stresses caused by moisture content changes of the expansive soil.

The primary object of the present invention is to provide an improved alternative for poured concrete foundations in expansive soil areas, which is sound from an engineering point of view, easy to construct, and also cost-efficient. To achieve the above object, the structural efficiency of the foundation structure, as a whole, is enhanced by integrating the foundation wall, perimeter footing, and internal footings and column footings located within the perimeter footing, in all three orthogonal directions, namely vertical and two horizontal directions.

BRIEF DESCRIPTION OF THE FIGURES

The present invention will be more readily understood by reference to the following description when read in conjunction with the attached drawings.

DETAILED DESCRIPTION OF THE INVENTION

Figure 1:
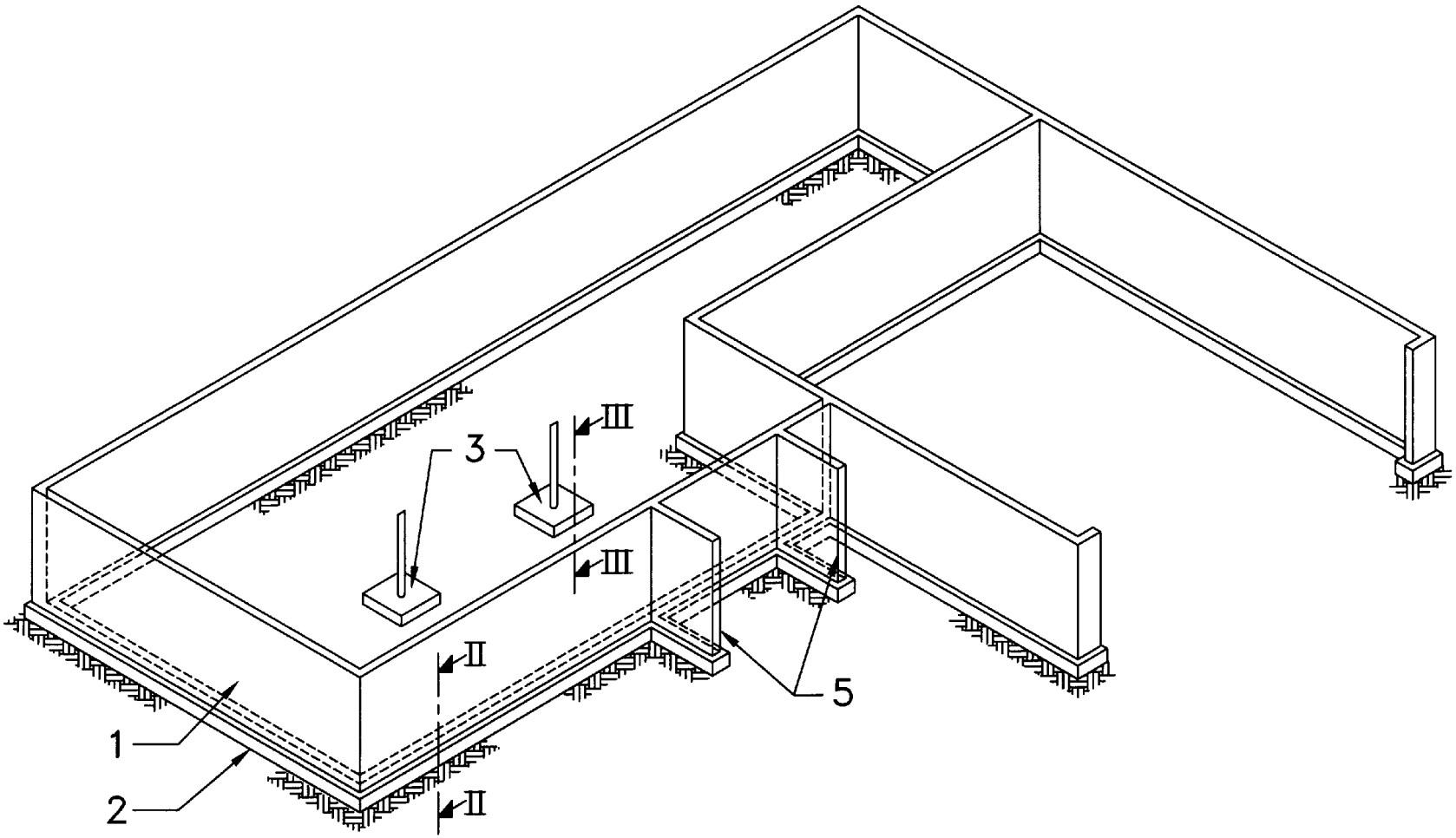
FIG. 1 (PRIOR ART)
FIG. 1 is an isometric view of poured, horizontally-elongated, upright concrete foundation walls resting on poured concrete perimeter footing of a typical residential house constructed in normal soils. This figure is of prior art.

In FIG. 1 which is a layout of a residential house foundation constructed in normal soils, concrete foundation wall is indicated by 1, perimeter concrete footing is indicated by 2, isolated column footings are indicated by 3, and structures provided to support a front stoop are depicted by 5.

Figure 3:
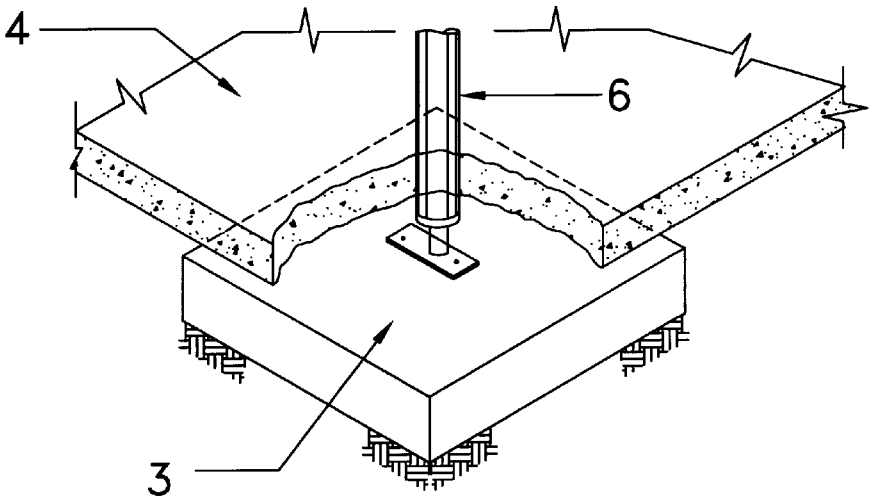
FIG. 3 (PRIOR ART)
FIG. 3 represents a sectional view of a concrete column footing along lines III—III of FIG. 1 with the basement slab also shown. This figure is also of prior art.
Figure 2:
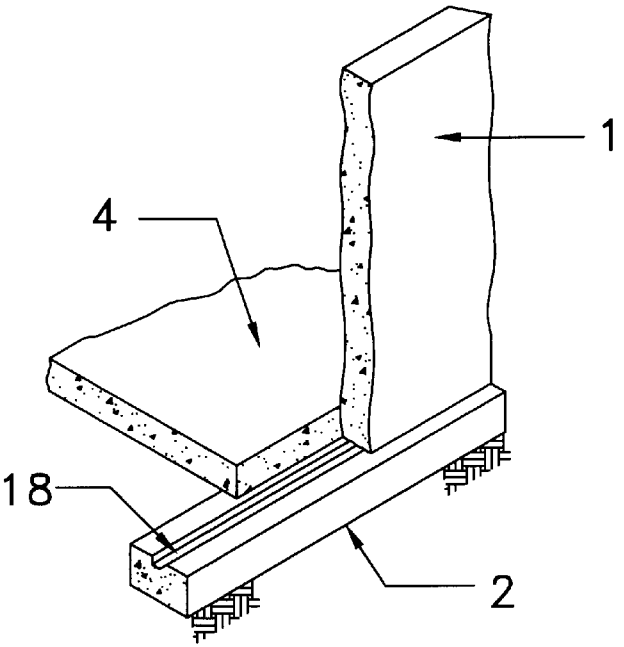
FIG. 2 (PRIOR ART)
FIG. 2 is a sectional view of the concrete foundation wall and perimeter footing along lines II—II of FIG. 1 with a basement slab also shown. This figure is also of prior art.

In normal soil subgrade, the foundation wall 1 and the perimeter footing 2 of FIG. 2, and the isolated column footing 3 of FIG. 3 that supports a column 6, are constructed as per conventional practice. In this practice, the footings 2 and 3 are constructed first; the foundation walls are then constructed over the perimeter footing 2; and finally the basement slab 4 is constructed using plain concrete with nominal steel and rests directly on the soil subgrade and the footings 2 and 3. After each of these construction steps, a time gap is maintained during which concrete that has been poured is allowed to set completely. Usually, a keyway 18 as shown in FIG. 2 is provided at the top of the perimeter footing to provide lateral restraint to the foundation wall. As chances for differential settlement are insignificant in normal soils, the above foundation structure is satisfactory.

Volumetric changes in expansive soils occur due to changes in moisture content of the soil mass. These volumetric changes cause major problems for structures constructed on such soils. If the moisture content of the expansive soil under a basement slab is allowed to increase, the slab will heave up and may even fail unless it is constructed to withstand expansive soil pressure, which would make the construction uneconomical.

In expansive soil subgrade, the invention recognizes that the widening of the perimeter footing and extending it to a depth depending on the shrinking or swelling characteristics of the subgrade, minimizes migration of moisture from the outside of the perimeter footing towards the soil mass below the basement slab, because of the increase of seepage path. Still some moisture migration does take place and this can give rise to stresses affecting the foundation structure.

A poured concrete foundation wall resists lateral horizontal load from soil backfill and also transfers vertical superimposed loads to an underlying footing. In addition to these two primary functions, a poured concrete foundation has the structural strength enabling it to behave as a beam. This capability of behaving as a beam has been exploited in the present invention to effectively counter troubles caused by expansive soils.

Figure 4:
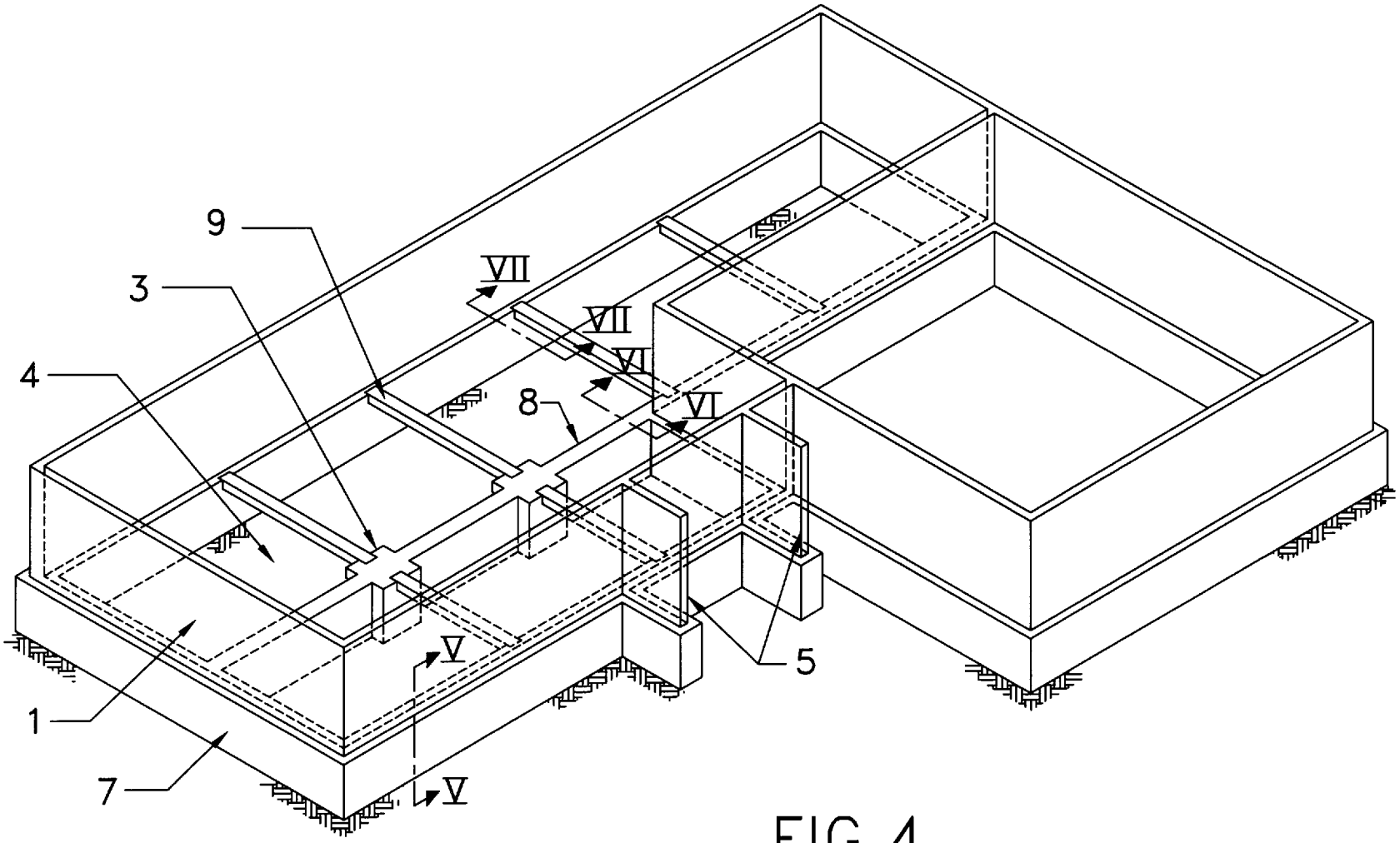
FIG. 4 is an isometric view of a foundation system of a residential house having foundation walls and constructed in expansive soils in accordance with the invention.
Figure 5:
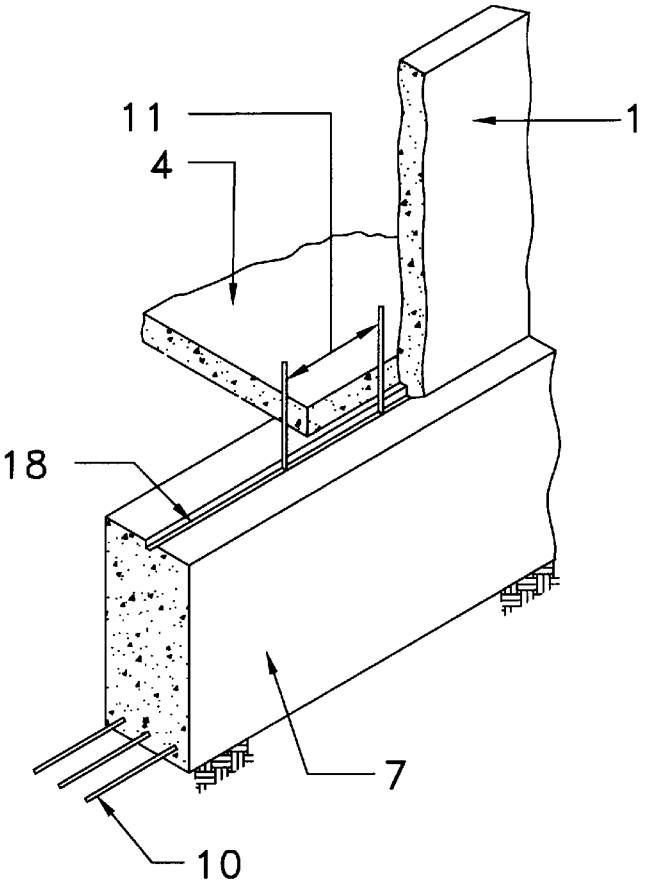
FIG. 5 is a sectional view along lines V—V of FIG. 4 for describing the arrangement for integrating the horizontally-elongated, upright, poured concrete foundation wall with the poured concrete trench footing.
Figure 8:
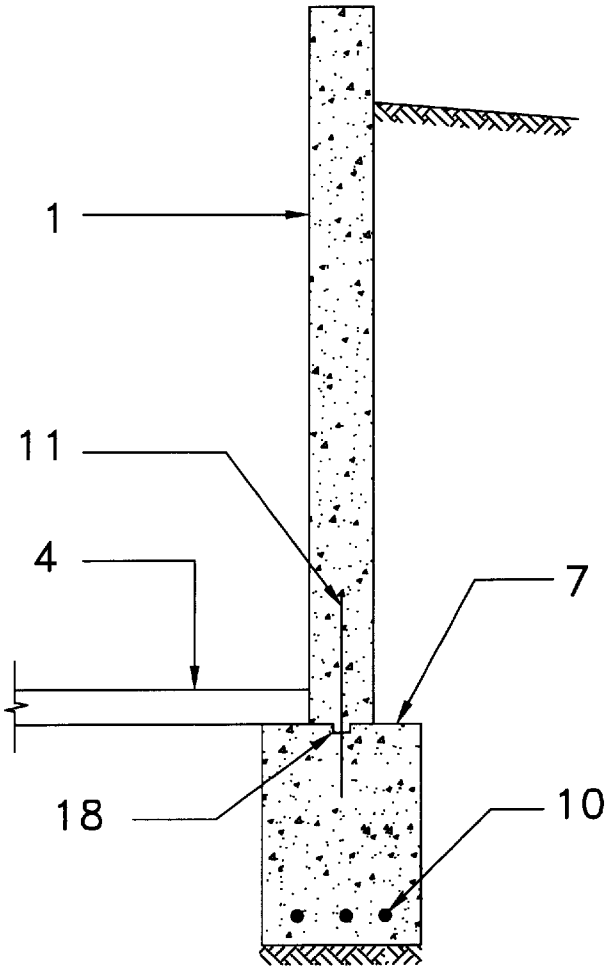
FIG. 8 is a cross-sectional view of the foundation wall and trench footing integrated together to form a deep inverted T-beam.

FIG. 4 depicts the foundation of a residential house having foundation walls and constructed in expansive soil subgrade according to the present invention. As shown in FIG. 5, the novel feature of the present invention is the use of vertical reinforcement dowels 11 at predetermined spacings, throughout the perimeter of the foundation, to integrate the perimeter trench footing 7 with the foundation wall 1 so that they act as a structural unit having an inverted T-beam cross-section. This T-beam as shown in FIG. 8 has reinforcing steel rods 10 and has a large Moment of Inertia and therefore, has enhanced beam capacity. This integration ensures that the foundation wall 1 also behaves as a beam in addition to resisting lateral soil backfill load and transferring vertical building loads to the perimeter trench footing 7.

In the current practice of foundation wall construction, if any vertical reinforcing steel dowels are provided to attach a foundation wall to its underlying footing, the heights and spacings of the provided dowels are such that they provide only lateral restraint to the bottom of the foundation wall; and they are not meant to ensure that the foundation wall and its underlying footing act as a single structural unit whereby the foundation wall is capable of behaving as a beam. Alternatively, in the current practice, a keyway 18 as shown in FIGS. 5, 8, 9 & 11 is provided at the top of the perimeter trench footing to provide lateral restraint to the foundation wall.

Figure 6:
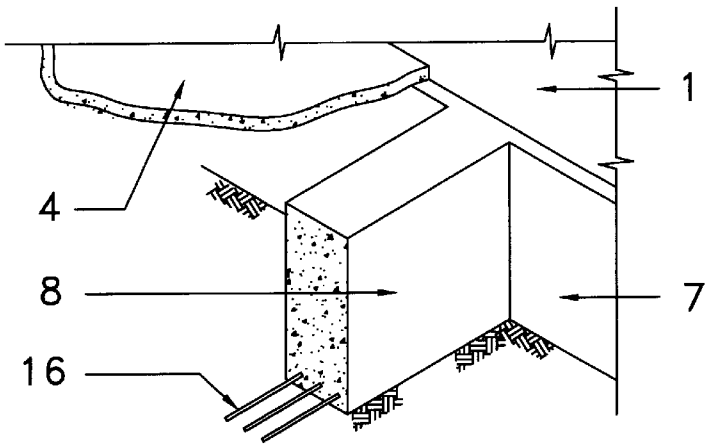
FIG. 6 depicts a sectional view along lines VI—VI of FIG. 4 for the purpose of describing the connection of column footings with the continuous perimeter trench footing through internal trench footings.

As shown in FIG. 6, the isolated column footings 3 are connected to the assembly of perimeter trench footing 7 and foundation wall 1 by means of internal trench footings 8 having reinforcing steel rods 16.

As the first step of construction of the foundation of this invention, the soil subgrade is excavated and cut in the desired shape, and concrete is poured to form the perimeter trench footing, internal trench footings and column footings monolithically. Vertical reinforcement dowels 11 of predetermined height are left protruding from the top of the perimeter trench footing at predetermined spacings. After the poured concrete has set, the foundation wall 1 is constructed over the perimeter trench footing 7 ensuring that the vertical reinforcing dowels 11 extend inside the foundation wall. After this, all ground work consisting of installation of plumbing, sewer and other pipes is done.

Figure 7:
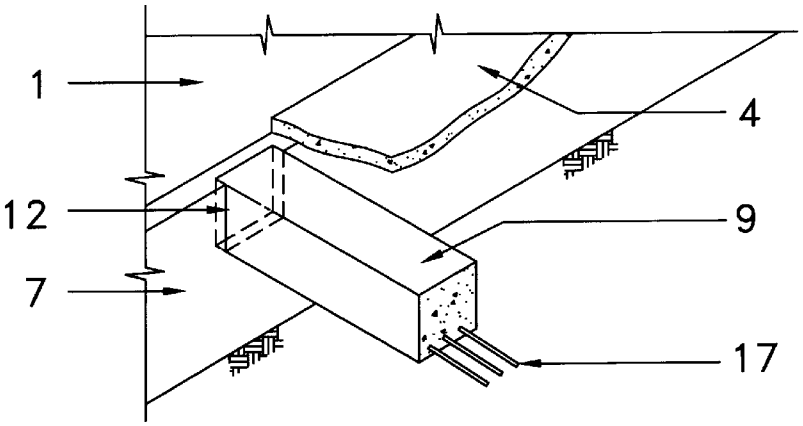
FIG. 7 is a sectional view along lines VII—VII of FIG. 4 for describing the placement of a grade beam at the perimeter trench footing.

The next step is to excavate the soil subgrade in the desired shape to form grade beams and basement slab. A layer of gravel of about 4 inches thickness is then put on the top of this excavated soil subgrade. Thereafter, the gravel is covered with a 6 mil polyethylene sheet, and reinforcement for grade beams and a basement slab is spread over the polyethylene sheet. The basement slab is designed either as a slab on grade or as a structural slab with normal loading. Finally, concrete is poured to form the grade beams and the basement slab monolithically. FIG. 7 describes the placement of a grade beam 9 having reinforcing steel rods 17 in a beam pocket 12. Once construction is complete, no gaps remain in the pockets through which air can pass through towards the underside of the basement slab from outside the periphery of the foundation structure or from above the basement slab.

In this foundation structure of the invention, the perimeter trench footing minimizes migration of moisture from the outside of the foundation periphery towards the soil mass beneath the basement slab. In the event of any moisture content change taking place, the monolithic construction of the perimeter trench footing, internal trench footings and column footings leads to a distribution of stresses from the enclosed expansive soil, and thereby minimizes tilting of any portion of the foundation structure as well as restricts relative vertical movement between the footings. The integration of the foundation wall with the trench footing into a structural unit, having properties of an inverted T-beam with a high Moment of Inertia, adds further to the safety of the foundation structure by eliminating any relative movement between the foundation wall and the trench footing.

The combined arrangement of the foundation walls and the footings in this invention can be viewed as a three-dimensional "Box" type of structure that isolates the expansive soil mass below the basement slab from the surrounding soil mass, and resists stresses of the expansive soil without any detrimental settlement. The novel features of the present invention provide this improved resistance against the stresses.

The beam pockets provided at the perimeter trench footing and the internal trench footings support ends of the subsequently-constructed grade beams that are monolithically constructed with the basement slab. As the compressive and expansive stresses of the expansive soil are effectively countered by the footings and the foundation walls, the grade beams and the basement slab are not subjected to these stresses.

Figure 9:
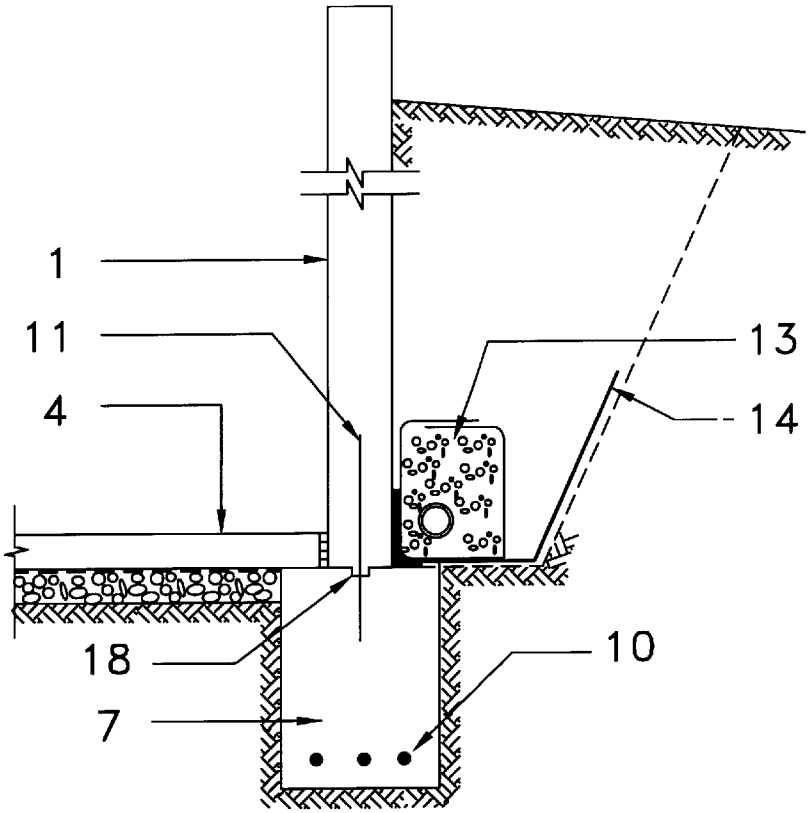
FIG. 9 represents a sectional view for the purpose of describing the details of a drain tile construction.

To drain out any surface drainage water that may seep from the yard adjacent to the foundation wall, a drain tile 13 as shown in FIG. 9 is to be used. A heavy polythene sheet 14 is also to be laid around the foundation wall 1.

Figure 10:
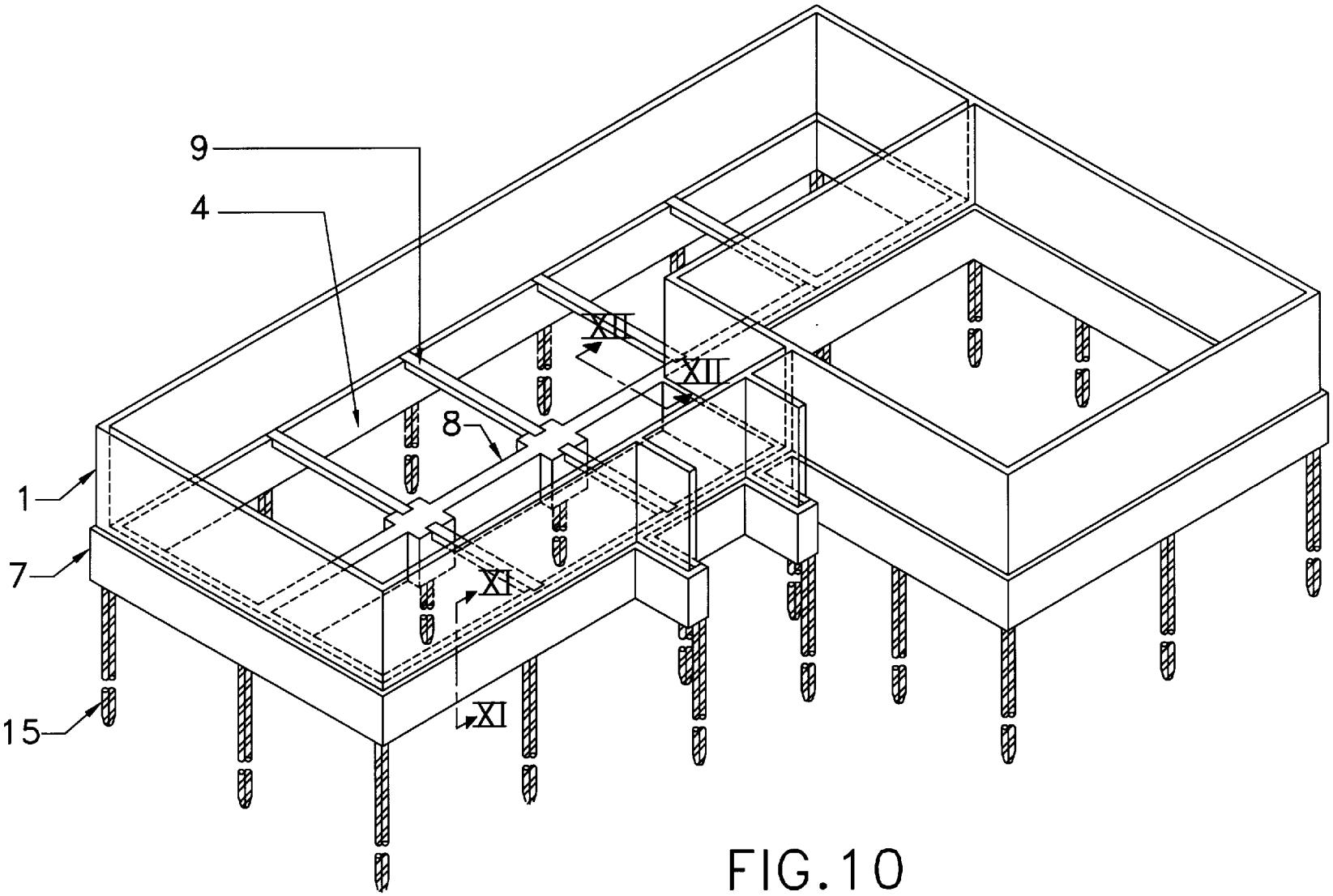
FIG. 10 depicts an isometric view of a foundation system constructed in expansive soils having lower bearing capacity than desired at the proposed footing bottom elevation. In this case, piles are used to transfer superimposed loads to deeper and firmer strata.
Figure 12:
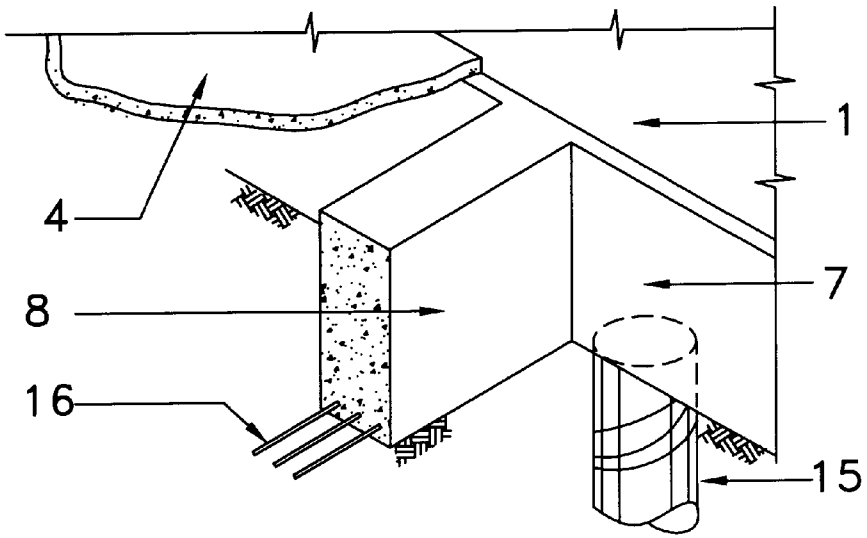
FIG. 12 depicts a sectional view along lines XII—XII of FIG. 10 for the purpose of describing the connection of internal trench footings with the continuous perimeter trench footing resting on piles.
Figure 11:
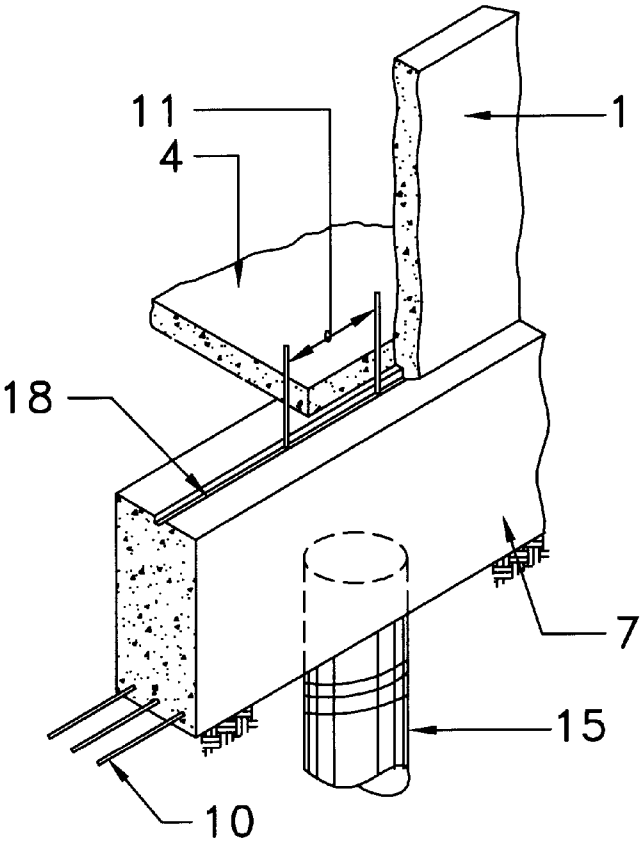
FIG. 11 is a sectional view along lines XI—XI of FIG. 10 for describing the arrangement of integrating the horizontally-elongated, upright, poured concrete foundation wall with the poured concrete trench footing supported on piles.

For expansive soils with lower bearing capacity than desired at the proposed footing bottom elevation, piles or caissons can be used to transfer the load to deeper and firmer strata (FIGS. 10, 11 and 12). These piles or caissons are to be provided immediately below the perimeter trench footing, internal trench footings and column footings.

While specific configurations have been set forth for the purpose of describing the novel features of the invention, it should be recognized that such specifics can be varied, by relying on the technology as taught, without departing from the principles of the invention. Therefore, in determining the scope of the present invention, reference shall be made to the appended claims.

What is claimed is:

1. A poured concrete foundation for residential houses having foundation walls and constructed in expansive soil, for improving resistance against effects due to shrinking and swelling of the expansive soil on account of variation in moisture content, said foundation comprising:

a perimeter trench footing, a plurality of column footings located within said perimeter trench footing, a plurality of internal trench footings connecting said column footings to said perimeter trench footing, a plurality of beam pockets provided on said perimeter trench footing and said internal trench footings, and a plurality of grade beams supporting a basement slab and resting at said beam pockets;

said perimeter trench footing, said column footings and said internal trench footings being constructed monolithically;

said grade beams being constructed monolithically with said basement slab, and no gaps remaining between said beam pockets and said grade beams through which air can pass through after the construction of said grade beams and said basement slab;

wherein the foundation comprises structural integration of said perimeter footing with a subsequently-constructed, overlying poured concrete foundation wall throughout the perimeter of said foundation, by means of vertical reinforcing steel dowels of predetermined height placed at predetermined spacings, and wherein the perimeter footing has a greater width than the foundation wall, so as to ensure that said foundation wall and said perimeter trench footing act together as a structural unit having an inverted T-beam cross-section with a large Moment of Inertia;

whereby said foundation wall behaves as a beam in addition to its primary functions of resisting lateral soil backfill load and transferring vertical building loads to said perimeter trench footing, and whereby said foundation acts as a three-dimensional structure that is capable of resisting stresses of the expansive soil without any detrimental settlement, and ensures that said grade beams and said basement slab are not subjected to any stress on account of shrinking or swelling of the expansive soil.

* * * * *